US010276992B2

(12) United States Patent
Graham et al.

(10) Patent No.: US 10,276,992 B2
(45) Date of Patent: Apr. 30, 2019

(54) PORT PROTECTORS WITH ADHESIVE AGENTS

(71) Applicant: Hewlett-Packard Development Company, L.P., Houston, TX (US)

(72) Inventors: Christoph Graham, Houston, TX (US); Tom Flynn, Magnolia, TX (US); Virginia Q. Herrera, Houston, TX (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 66 days.

(21) Appl. No.: 15/521,784

(22) PCT Filed: May 15, 2015

(86) PCT No.: PCT/US2015/031095
§ 371 (c)(1),
(2) Date: Apr. 25, 2017

(87) PCT Pub. No.: WO2016/186615
PCT Pub. Date: Nov. 24, 2016

(65) Prior Publication Data

US 2017/0250491 A1 Aug. 31, 2017

(51) Int. Cl.
*H01R 13/62* (2006.01)
*H01R 4/04* (2006.01)
(Continued)

(52) U.S. Cl.
CPC ..... *H01R 23/7036* (2013.01); *H01R 4/04* (2013.01); *H01R 13/443* (2013.01);
(Continued)

(58) Field of Classification Search
CPC ..... H01R 13/6397; H01R 13/443; H01R 13/639; H01R 13/44; Y10T 70/5009; G06F 21/88; H05K 5/0278; E05B 73/0082
(Continued)

(56) References Cited

U.S. PATENT DOCUMENTS 6,149,456 A * 11/2000 Uchiyama ..... H01R 13/521 439/488
6,641,417 B2 * 11/2003 Tanaka ..... H01R 13/5216 439/205
(Continued)

FOREIGN PATENT DOCUMENTS

KR 202013005401 9/2013
WO WO-2016118106 7/2016

OTHER PUBLICATIONS

USB Glue: Super Endpoint Security Glue, 2015, pp. 1-2, Available at: <usbglue.com/>.

*Primary Examiner* — Edwin A. Leon
*Assistant Examiner* — Matthew T Dzierzynski
(74) *Attorney, Agent, or Firm* — Brooks, Cameron & Huebsch, PLLC

(57) ABSTRACT

An example port protector includes a plug housing including an exterior surface and an interior surface, the plug housing sized to mate with a data communication port of an electronic device. The port protector also includes an opening extending from the exterior surface to the interior surface. The port protector further includes a storage container disposed within the plug housing, the storage container to release an adhesive agent via the opening based on an interaction between the plug housing and the data communication port.

14 Claims, 5 Drawing Sheets

(51) Int. Cl.

| | |
|---|---|
| ***H01R 12/50*** | (2011.01) |
| ***H01R 13/447*** | (2006.01) |
| ***H01R 13/639*** | (2006.01) |
| ***H01R 24/62*** | (2011.01) |
| ***H01R 13/443*** | (2006.01) |
| ***H01R 13/52*** | (2006.01) |
| *H01R 103/00* | (2006.01) |

(52) U.S. Cl.
CPC ..... *H01R 13/447* (2013.01); *H01R 13/5216* (2013.01); *H01R 13/6397* (2013.01); *H01R 23/7031* (2013.01); *H01R 24/62* (2013.01); *H01R 2103/00* (2013.01); *Y10S 439/936* (2013.01)

(58) Field of Classification Search
USPC ..... 439/133, 135, 304, 680, 148, 271
See application file for complete search history.

(56) References Cited

U.S. PATENT DOCUMENTS

| | | | | |
|---|---|---|---|---|
| 7,390,201 | B1 | 6/2008 | Quinby et al. | |
| 7,402,086 | B2 | 7/2008 | Pomerantz et al. | |
| 7,537,475 | B2 * | 5/2009 | Wise | H01R 13/62 439/276 |
| 8,449,309 | B1 | 5/2013 | Mosholder | |
| 8,814,606 | B2 * | 8/2014 | Endo | H01R 13/405 439/736 |
| 9,478,893 | B2 * | 10/2016 | Endo | H01R 43/005 |
| 2006/0107073 | A1 | 5/2006 | Lane et al. | |
| 2006/0134962 | A1 | 6/2006 | Yeh | |
| 2007/0037454 | A1 | 2/2007 | Bushby | |
| 2008/0299824 | A1 | 12/2008 | Legg | |
| 2012/0289069 | A1 | 11/2012 | Chueh et al. | |
| 2015/0171543 | A1 * | 6/2015 | Sittner | H01R 13/405 439/271 |

* cited by examiner

PORT PROTECTORS WITH ADHESIVE AGENTS

CROSS-REFERENCE TO RELATED APPLICATION

This application is a U.S. National Stage Application of and claims priority to International Patent Application No. PCT/US2015/031095, filed on May 15, 2015, and entitled "PORT PROTECTORS WITH ADHESIVE AGENTS."

BACKGROUND

An electronic device, such as a desktop computer, may include a plurality of data communication ports. For example, a data communication port may be a serial port. As another example, a data communication port may be a universal serial bus (USB) port.

BRIEF DESCRIPTION OF THE DRAWINGS

Some examples of the present application are described with respect to the following figures.

DETAILED DESCRIPTION

An electronic device with data communication ports may exchange information with other electronic devices via the data communication ports. For example, a flash drive may be coupled to an electronic device via a universal serial bus (USB) port of the electronic device. Information may be transferred to the flash drive via the USB port. However, the data communication ports may also increase the likelihood that the electronic device is exposed to unauthorized access via the data communication ports.

Examples described herein provide a port protector with adhesive agent to block access to a data communication port, such as a USB port. For example, a port protector may include a plug housing. The plug housing may include an exterior surface and an interior surface, the plug housing sized to mate with a data communication port of an electronic device. The port protector may also include an opening extending from the exterior surface to the interior surface. The port protector may further include a storage container disposed within the plug housing, the storage container to release an adhesive agent via the opening based on an interaction between the plug housing and the data communication port. In this manner, examples described herein may reduce the likelihood that an electronic device is exposed to unauthorized access via data communication ports.

Figure 1A:
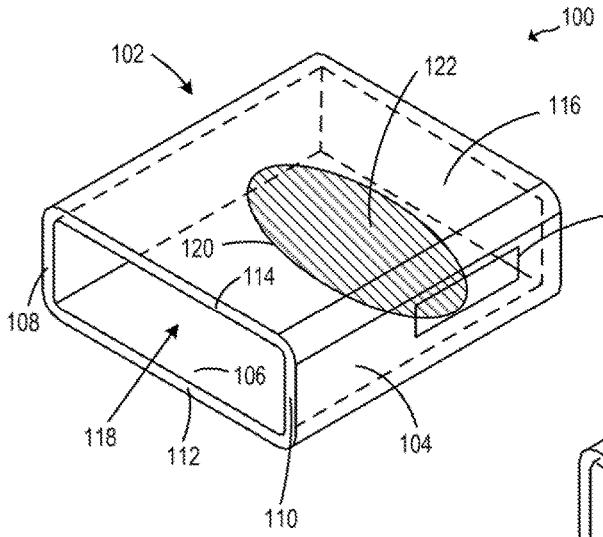
FIG. 1A is a block diagram of a port protector with an adhesive agent, according to an example.

Referring now to the figures, FIG. 1A is a block diagram of a port protector 100 with an adhesive agent, according to an example. Port protector 100 may include a plug housing 102. Plug housing 102 may have a generally rectangular shaped. Plug housing 102 may be sized or shaped to mate with a data communication port. In some examples, plug housing 102 may be sized to mate with a USB port, such as a type A USB port, a type B USB port, a type C USB port, a mini-A USB port, a mini-AB USB port, a micro-AB USB port, a micro-B USB port, etc.

Plug housing 102 may include an exterior surface 104 and an interior surface 106. Plug housing 102 may also include a plurality of sidewalls, such a first sidewall 108, a second sidewall 110, a third sidewall 112, and a fourth sidewall 114. Plug housing 102 may further include an end wall 116. Sidewalls 108-114 and end wall 116 may define a cavity 118.

Port protector may also include a storage container 120 that is disposed within cavity 118. Storage container 120 may hold or store adhesive agent 122. Storage container 120 may be made from flexible material, such as plastic film. In some examples, storage container 120 may be implemented as a plastic pouch. In some examples, storage container 120 may be made from a material that does not react with adhesive agent 122. Thus adhesive agent 122 may not bond to storage container 120 while being held or stored in storage container 120.

Adhesive agent 122 may be any substance that is bonds materials together and resist separation upon bonding. In some examples, adhesive agent 122 may be implemented using non-conductive glue, such as cyanoacrylate glue. In some examples, adhesive agent 122 may be implemented using non-conductive epoxy adhesive. When adhesive agent 122 is implemented using non-conductive epoxy adhesive, storage container 120 may include a plurality of internal storage containers, which are described in more detail in FIG. 2B.

During operation, storage container 120 may release adhesive agent 122 so that plug housing 102 may be fixated or bonded to a data communication port using adhesive agent 122. Adhesive agent 122 may be in liquid form so that storage container 120 may release adhesive agent 122 via an opening 124 of port protector 100. Opening 124 may be located on a sidewall of plug housing 102, such as second sidewall 110, and may align with storage container 120. Opening 124 may extend from interior surface 106 to exterior surface 104. Storage container 120 may release adhesive agent 122 based on an interaction between plug housing 102 and a data communication port. Releasing adhesive agent 122 is described in more detail in FIG. 10.

Figure 1B:
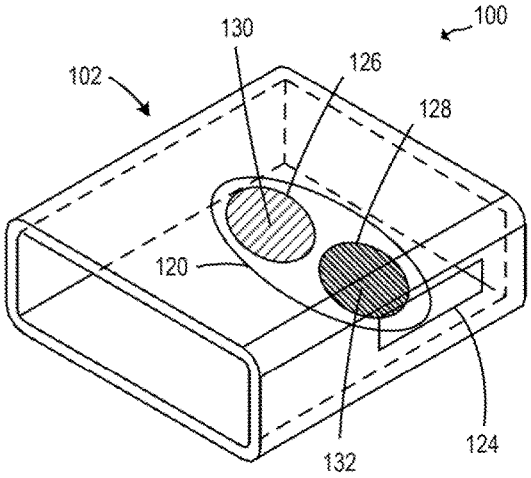
FIG. 1B is a block diagram of a port protector with an adhesive agent, according to another example.

FIG. 1B is a block diagram of port protector 100 with an adhesive agent, according to another example. Storage container 120 may hold or store a first internal storage container 126 and a second internal storage container 128. First internal storage container 126 may hold or store epoxy resin 130 and second internal storage container 128 may hold or store curing agent 132. Epoxy resin 130 and curing agent 132 may implement adhesive agent 122. When storage container 120 release epoxy resin 130 and curing agent 132 via opening 124, curing agent 132 may activate epoxy resin 130 so that epoxy resin 130 hardens to bond plug housing 102 to a data communication port.

Figure 1C:
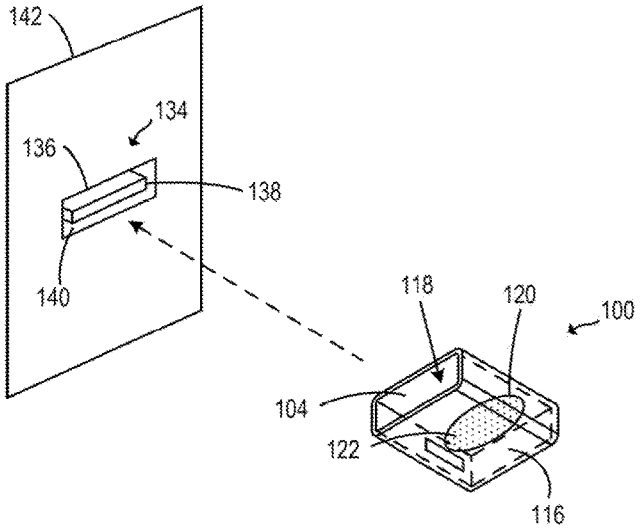
FIG. 1C is a block diagram of a port protector with an adhesive agent, according to another example.

FIG. 1C is a block diagram of port protector 100 with an adhesive agent, according to another example. During operation, port protector 100 may be plugged into a data communication port 134 of an electronic device 142 to block access to data communication port 134. Electronic device 142 may be, for example, a web-based server, a local area network server, a cloud-based server, a notebook computer, a desktop computer, an all-in-one system, a tablet electronic device, a mobile phone, an electronic book reader, or any other electronic device having a data communication port, such as data communication port 134. Data communication port 134 may be a physical interface between an electronic device and another electronic device or component. As an example, data communication port 134 may be a USB port. Data communication port 134 may include a housing 136 and an electrical contact pad 138 disposed within housing 136. Electrical contact pad 138 may be an internal structure of data communication port 134 that houses electrical contacts (not shown) used for data communication.

When port protector 100 is plugged into data communication port 134, plug housing 102 may be disposed within housing 136. Electrical contact pad 138 may extend into cavity 118 to compress storage container 120 against end wall 116 until the compression causes storage container 120 to burst. Thus, adhesive agent 122 may be released via opening 24. Adhesive agent 122 may exit plug housing 102 and come into contact with an interior surface 140 of housing 136 and exterior surface 104 of plug housing 102. Thus, adhesive agent 122 may bond housing 136 to plug housing 102 so that access to data communication port 134 is blocked.

Figure 2:
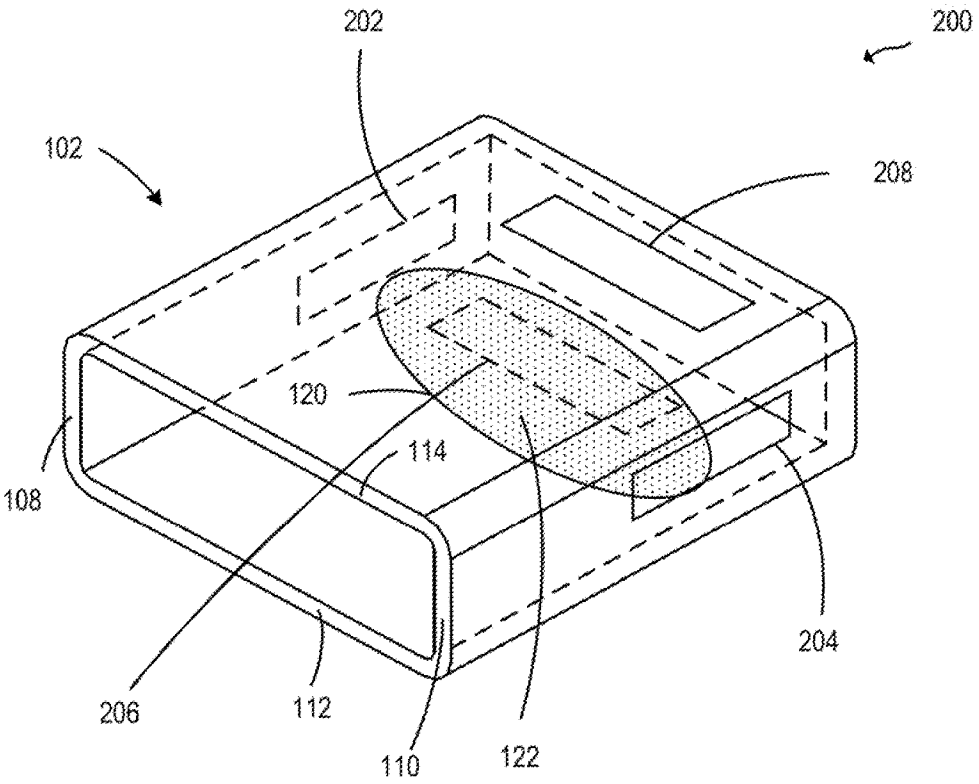
FIG. 2 is a block diagram of a port protector with an adhesive agent, according to another example.

FIG. 2 is a block diagram of a port protector 200 with an adhesive agent, according to another example. Port protector 200 may include plug housing 102 and storage container 120 with adhesive agent 122. Port protector 200 may also include a plurality of openings, 202-208. Opening 202 may be located on first sidewall 108. Opening 204 may be located on second sidewall 110. Opening 206 may be located on third sidewall 112. Opening 208 may be located on fourth sidewall 114. When storage container 120 is burst to release adhesive agent 122, adhesive agent 122 may exit plug housing 102 via openings 202-208 to increase the amount of bonding with a data communication port, such as data communication port 134.

Figure 3:
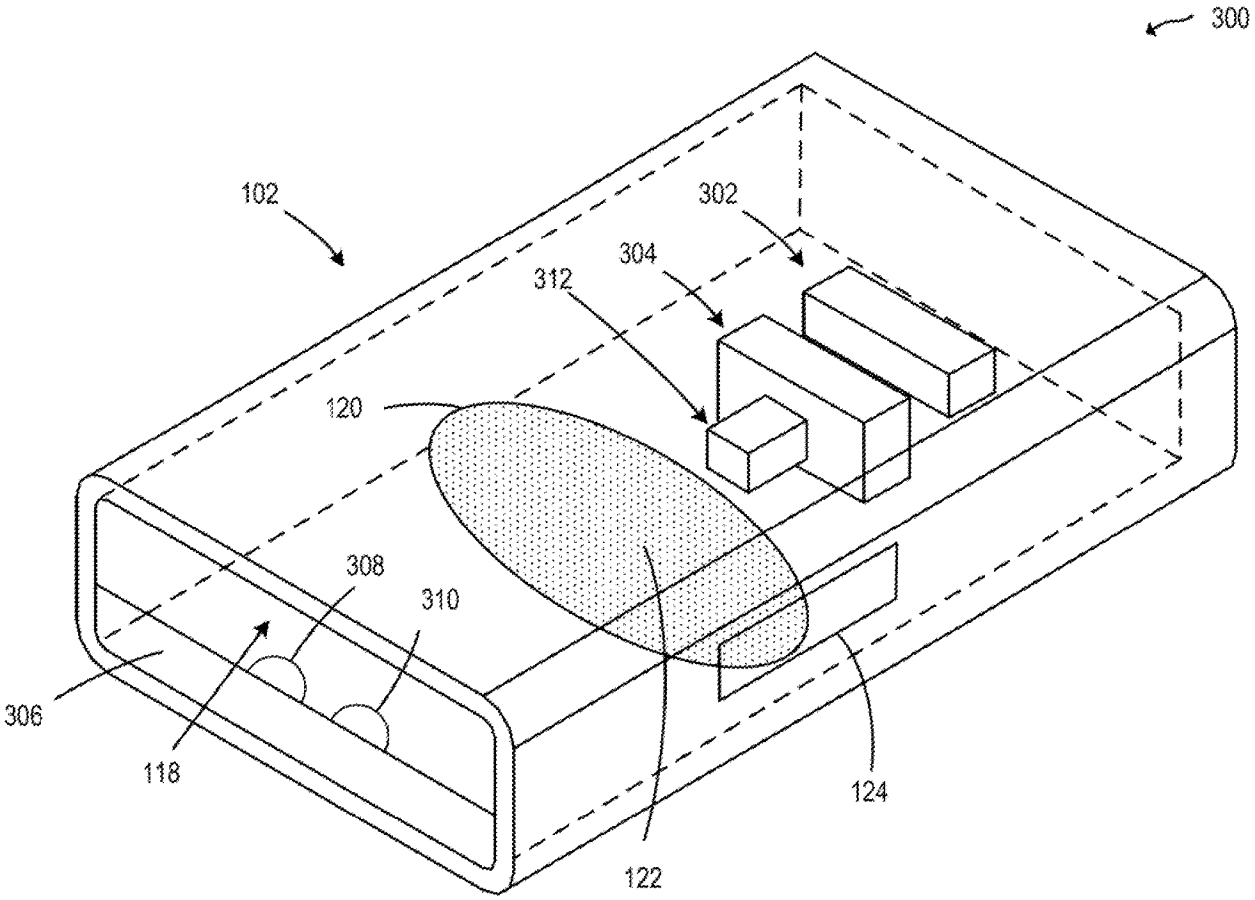
FIG. 3 is a block diagram of a port protector with an adhesive agent, according to another example.

FIG. 3 is a block diagram of a port protector 300 with an adhesive agent, according to another example. Port protector 300 may include plug housing 102, storage container 120, an actuator 304, a controller 302, and an electrical contact pad 306. Actuator 304 and controller 302 may correspond to a release mechanism. Actuator 304, controller 302, and electrical contact pad 306 may be disposed in cavity 118. Electrical contact pad 306 may be similar to electrical contact pad 138 of FIG. 1C. Controller 302 and actuator 304 may be electrically coupled via metal traces (not shown) so that controller 302 may control actuator 304. Controller 302 may be electrically coupled to electrical contacts 308-310 via metal traces (not shown) so that controller 302 may perform data communication with an electronic device. It should be understood that port protector 300 may include any number of electrical contacts. Actuator 304 may include a release rod 312 to engage storage container 120 to release adhesive agent 122 via opening 124. Controller 302 may direct operations of actuator 304. Operations of actuator 304 and controller 302 are described in more detail in FIGS. 4A-4B. Although a single opening is shown in FIG. 3, it should be understood that port protector 300 may include a plurality of openings, such as openings 202-208 of FIG. 2.

Figure 4A:
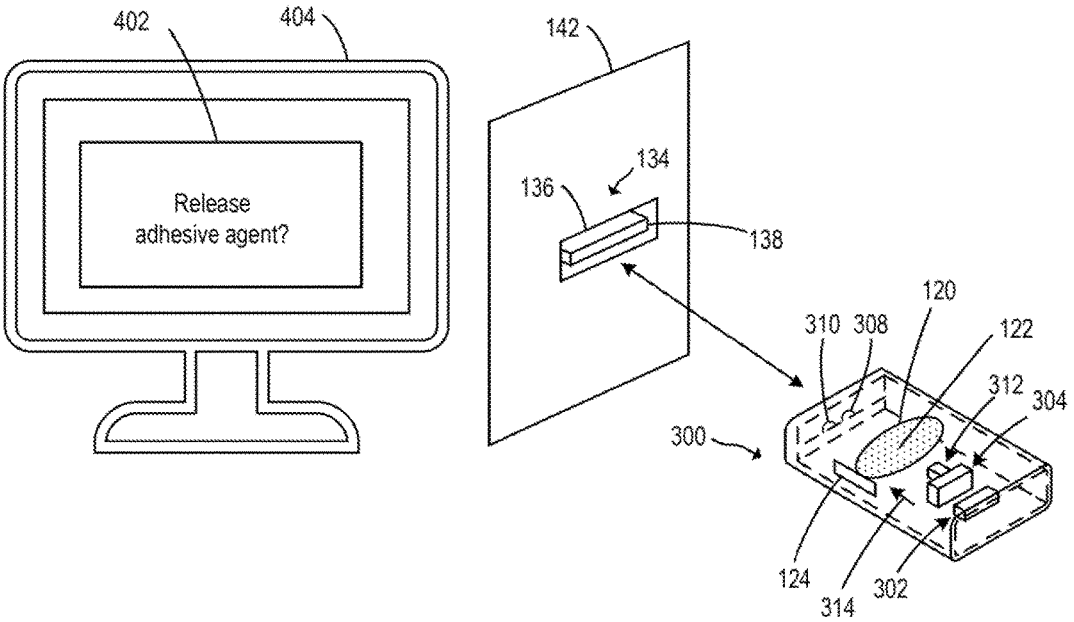
FIG. 4A is a block diagram of a port protector with an adhesive agent, according to another example.

FIG. 4A a block diagram of port protector 300 of FIG. 3 with an adhesive agent, according to another example. During operation, port protector 300 may be plugged into data communication port 134 of electronic device 142 to block access to data communication port 134. Controller 302 may establish a connection with electronic device 142 via electrical contacts 308 and 310, such as a USB connection. Controller 302 may transmit a release message 402 to electronic device 142 via the connection. Electronic device 142 may display release message 402 on a display device 404 of electronic device 142, such as liquid crystal display (LCD), to solicit permission from a user of electronic device 142 to determine whether adhesive agent 122 is to be released to bond port protector 300 to data communication port 134.

When electronic device 142 receives the permission, such as an input from a user via a keyboard or other input device confirming that the user wishes to have adhesive agent 122 released, electronic device 142 may generate a confirmation message (not shown in FIG. 4A) and transmit the confirmation message to controller 302 via electrical contact pad 138. In response to receiving the confirmation message, controller 302 may direct actuator 304 to move or extend release rod 312 (as indicated by an arrow 314) to engage storage container 120 to release adhesive agent 122 via opening 124. For example, release rod 312 may press storage container 120 against electrical contact pad 138 until storage container 120 is punctured or burst. In another example, release rod 312 may have a sharp tip to puncture or burst storage container 120. Once storage container 120 is punctured or burst, adhesive agent 122 may exit port protector 300 via opening 124 to bond port protector 300 to data communication port 134. Thus, by controlling the timing of adhesive agent 122, the likelihood of accidentally blocking access to data communication port 134 may be reduced.

Figure 4B:
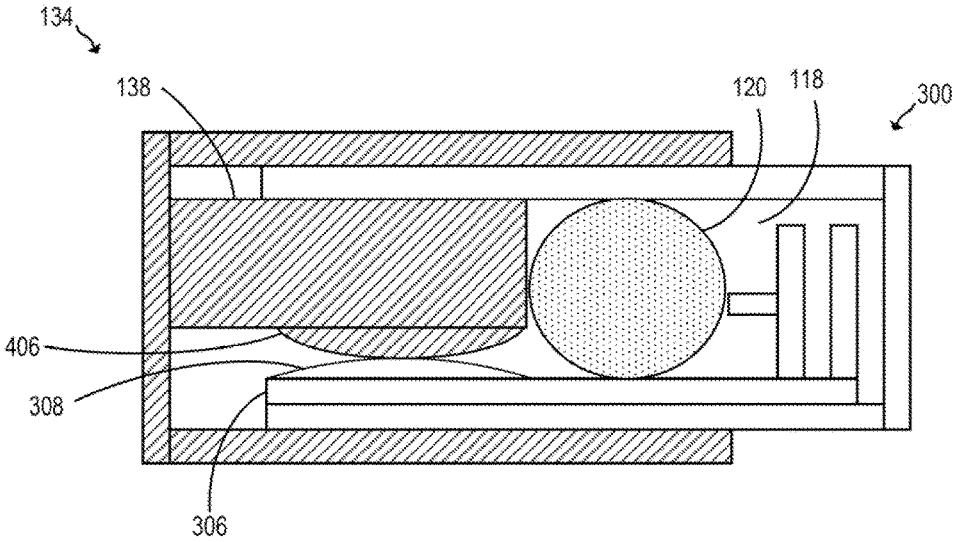
FIG. 4B is a cross-section view of a port protector engaged with a data communication port, according to an example.

FIG. 4B is a cross-section view of port protector 300 engaged with data communication port 134, according to an example. As illustrated in FIG. 4B, when port protector 300 is plugged into data communication port 134, electrical contacts of port protector 300, such as electrical contact 308, may be in physical contact with electrical contacts of data communication port 134, such as an electrical contact 406 embedded in electrical contact pad 138. Thus, controller 302 may communicate electronic device 142 (not shown in FIG. 4B) using a communication protocol, such as the USB protocol.

Storage container 120 may be attached to electrical contact pad 306 via adhesive or may be affixed within cavity 118 via friction. Storage container 120 may be located within cavity 118 so that electrical contact pad 138 may rest against storage container 120 when port protector 300 is plugged into data communication port 134. Thus, when actuator 304 extends or moves release rod 312 to engage storage container 120, release rod 312 may cause storage container 120 to deform until bursting or to be punctured.

Figure 5:
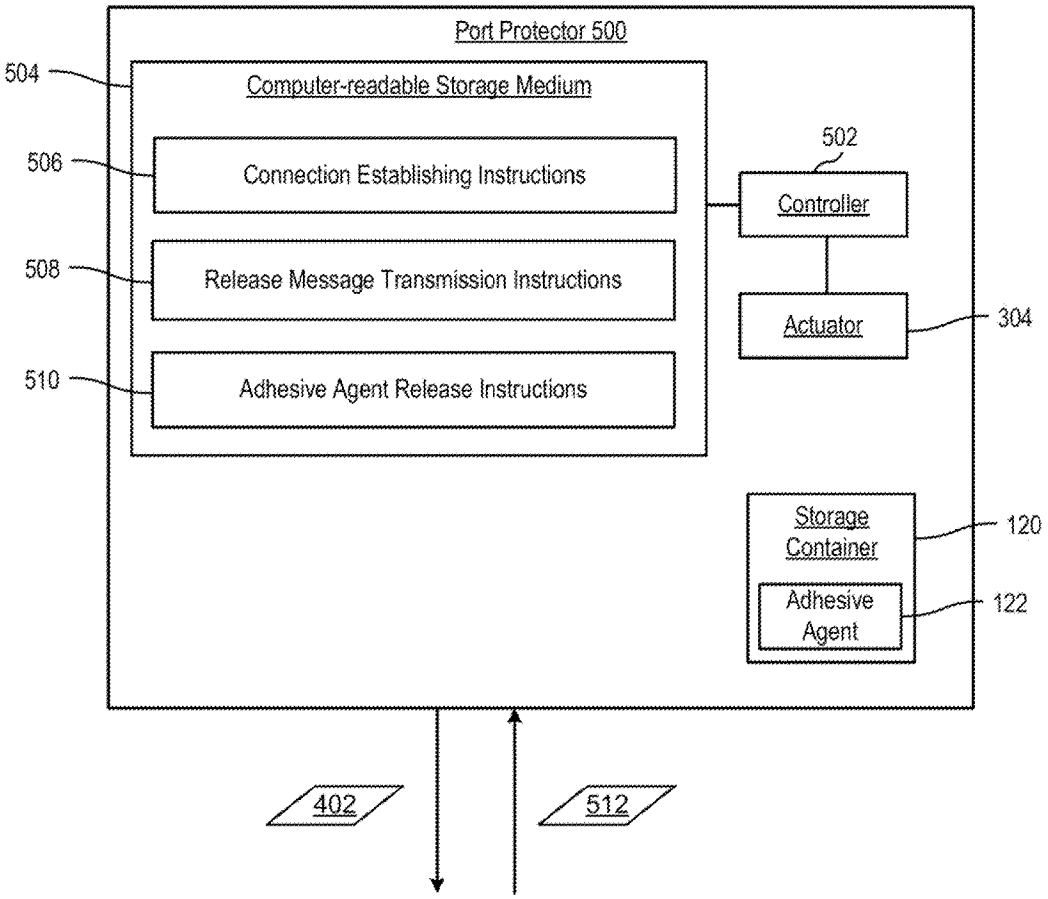
FIG. 5 is a block diagram of a port protector with an adhesive agent, according to another example.

FIG. 5 is a block diagram of a port protector 500 with an adhesive agent, according to another example. Port protector 500 may implement port protector 300 of FIGS. 3, 4A, and 4B. Port protector 500 may include a controller 502, a computer-readable storage medium 504, actuator 304, storage container 120, and adhesive agent 122. Controller 502 may implement controller 302. Controller 502 may a semiconductor-based microprocessor and/or other hardware devices suitable for retrieval and execution of instructions stored in a computer-readable storage medium, such as computer-readable storage medium 504.

Computer-readable storage medium 504 may be any electronic, magnetic, optical, or other physical storage device that contains or stores executable instructions. Thus, computer-readable storage medium 504 may be, for example, Random Access Memory (RAM), an Electrically Erasable Programmable Read-Only Memory (EEPROM), a storage device, an optical disc, etc. In some examples, computer-readable storage medium 504 may be a non-transitory storage medium, where the term "non-transitory" does not encompass transitory propagating signals. As described in detail below, computer-readable storage medium 504 may be encoded with a series of processor executable instructions 506, 508, and 510 for releasing adhesive agent 122 from storage container 120.

Connection establishing instructions 506 may establish a connection with an electronic device via a data communication port of the electronic device. For example, referring to FIG. 4A, controller 302 may establish a connection with electronic device 142 via electrical contacts 308 and 310, such as a USB connection. Release message transmission instructions 508 may transmit release message 402 to an electronic device to solicit permission to release adhesive agent 122. For example, referring to FIG. 4A, controller 302 may transmit release message 402 to electronic device 142 via the connection. Adhesive agent release instructions 510 may release adhesive agent 122 from storage container 120 via actuator 304 in response to receiving a confirmation 512. Confirmation 512 may be generated by the electronic device based on release message 402. For example, referring to FIG. 4A, in response to receiving the confirmation message, controller 302 may direct actuator 304 to move or extend release rod 312 (as indicated by an arrow 314) to engage storage container 120 to release adhesive agent 122 via opening 124.

The use of "comprising", "including" or "having" are synonymous and variations thereof herein are meant to be inclusive or open-ended and do not exclude additional unrecited elements or method steps.

What is claimed is:

1. A port protector comprising:

a plug housing including an exterior surface and an interior surface, the plug housing sized to mate with a data communication port of an electronic device;

an opening extending from the exterior surface to the interior surface; and a storage container disposed within the plug housing, the storage container to release an adhesive agent via the opening in response to a controller directing an actuator to direct the storage container to release the adhesive agent based on a confirmation message received from the electronic device via the data communication port.

2. The port protector of claim 1, wherein the data communication port is compliant with a universal serial bus (USB) protocol.

3. The port protector of claim 1, wherein the plug housing includes:

a first sidewall;

a second sidewall;

an end wall; and a cavity defined by the first sidewall, the second sidewall, and the end wall, and wherein the storage container is disposed within the cavity.

4. The port protector of claim 3, wherein the first sidewall includes the opening, and wherein the second sidewall includes a second opening, and wherein the adhesive agent is to bond the plug housing to the data communication port via the opening and the second opening.

5. The port protector of claim 3, wherein the interaction includes a compression of the storage container by an internal structure of the data communication port and the end wall.

6. The port protector of claim 1, wherein the adhesive agent includes non-conductive epoxy adhesive or non-conductive glue.

7. A port protector comprising:

a plug housing including an exterior surface and an interior surface, the plug housing sized to mate with a data communication port of an electronic device;

an opening extending from the exterior surface to the interior surface;

a storage container disposed within the plug housing; and a release mechanism disposed within the plug housing, the release mechanism to release an adhesive agent from the storage container, the adhesive agent to exit the plug housing via the opening, wherein the release mechanism includes a controller and an actuator, and wherein the actuator is to release the adhesive agent from the storage container based on a confirmation message received from the electronic device via the data communication port.

8. The port protector of claim 7, wherein the data communication port is compliant with a universal serial bus (USB) protocol.

9. The port protector of claim 7, wherein the adhesive agent includes non-conductive epoxy adhesive or non-conductive glue.

10. A non-transitory computer-readable storage medium comprising instructions that when executed cause a controller of a port protector to:

transmit a release message to the electronic device via a connection with an electronic device via a data communication port of the electronic device; and in response to receiving a confirmation message, direct an actuator to release an adhesive agent from a storage container of the port protector to bond the port protector to the data communication port via an opening of the port protector, wherein the confirmation message is generated based on the release message.

11. The computer-readable storage medium of claim 10, wherein the release message is to cause the electronic device to solicit a permission to release the adhesive agent.

12. The computer-readable storage medium of claim 10, wherein the connection is a universal serial bus (USB) connection.

13. The computer-readable storage medium of claim 10, wherein the adhesive agent includes non-conductive epoxy adhesive or non-conductive glue.

14. The computer-readable storage medium of claim 10, wherein the release message is to be displayed via a display of the electronic device.

* * * * *